US010562034B2

(12) United States Patent
Matsumoto et al.

(10) Patent No.: US 10,562,034 B2
(45) Date of Patent: Feb. 18, 2020

(54) ROLLER MILL AND METHOD FOR MANUFACTURING ROLLER MILL

(71) Applicant: MITSUBISHI HITACHI POWER SYSTEMS, LTD., Yokohama-shi (JP)

(72) Inventors: Shinji Matsumoto, Tokyo (JP); Takuichiro Daimaru, Tokyo (JP); Kazushi Fukui, Tokyo (JP); Takashi Tsutsuba, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 885 days.

(21) Appl. No.: 15/032,756

(22) PCT Filed: Sep. 8, 2014

(86) PCT No.: PCT/JP2014/073654

§ 371 (c)(1),
(2) Date: Apr. 28, 2016

(87) PCT Pub. No.: WO2015/087590

PCT Pub. Date: Jun. 18, 2015

(65) Prior Publication Data

US 2016/0243555 A1 Aug. 25, 2016

(30) Foreign Application Priority Data

Dec. 13, 2013 (JP) ..... 2013-257848

(51) Int. Cl.
*B02C 15/00* (2006.01)
*B02C 15/04* (2006.01)

(52) U.S. Cl.
CPC ..... *B02C 15/003* (2013.01); *B02C 15/004* (2013.01); *B02C 15/04* (2013.01); *B02C 2015/002* (2013.01)

(58) Field of Classification Search
CPC ..... B02C 15/003; B02C 15/004; B02C 15/04; B02C 2015/002
See application file for complete search history.

(56) References Cited

U.S. PATENT DOCUMENTS 5,346,148 A 9/1994 Hand et al.
2017/0320064 A1* 11/2017 Matsumoto ..... B02C 23/30
(Continued)

FOREIGN PATENT DOCUMENTS

CN 85105208 A 1/1987
CN 85105208 B 4/1987
(Continued)

OTHER PUBLICATIONS

International Search Report dated Dec. 2, 2014 in corresponding International Application No. PCT/JP2014/073654.
(Continued)

*Primary Examiner* — Omar Flores Sanchez
(74) *Attorney, Agent, or Firm* — Wenderoth, Lind & Ponack, L.L.P.

(57) ABSTRACT

Provided is a roller mill that is provided with: a rotary table; a raw coal adding tube that supplies solid fuel to the rotary table; and a roller that rotates about a rotating shaft by being pressed against a grinding surface of the rotary table and grinds solid fuel along with rotation of the rotary table. In such a roller mill, a position where an outer peripheral surface of the roller and the grinding surface of the rotary table come into contact with each other and a circumferential velocity of the outer peripheral surface equals a circumferential velocity of the grinding surface is located further to an inner circumferential side of the rotary table than a position where the outer peripheral surface and the grinding surface come into contact with each other at a center position in a width direction of the roller.

4 Claims, 8 Drawing Sheets

(56) References Cited

U.S. PATENT DOCUMENTS

| | | | | |
|---|---|---|---|---|
| 2018/0071745 | A1* | 3/2018 | Hirose | B02C 15/04 |
| 2018/0221889 | A1* | 8/2018 | Matsumoto | B02C 15/04 |
| 2018/0280990 | A1* | 10/2018 | Oba | B22C 5/06 |
| 2018/0372313 | A1* | 12/2018 | Kashima | B02C 15/001 |
| 2019/0143338 | A1* | 5/2019 | Nariai | B02C 23/26 |

FOREIGN PATENT DOCUMENTS

| | | |
|---|---|---|
| CN | 1054204 | 9/1991 |
| CN | 1102141 | 5/1995 |
| JP | 2-63559 | 3/1990 |
| JP | 2-222735 | 9/1990 |
| JP | 2000-325806 | 11/2000 |
| JP | 2000-354778 | 12/2000 |
| JP | 2003-117415 | 4/2003 |
| JP | 4101709 | 6/2008 |

OTHER PUBLICATIONS

Written Opinion of the International Searching Authority dated Dec. 2, 2014 in corresponding International Application No. PCT/JP2014/073654.

Office Action dated Mar. 31, 2017 in corresponding Chinese Application No. 201480056191.1, with English translation.

Office Action dated Apr. 29, 2019 in corresponding Indian Application No. 201647015958.

* cited by examiner

ROLLER MILL AND METHOD FOR MANUFACTURING ROLLER MILL

TECHNICAL FIELD

The present invention relates to a roller mill and a method for manufacturing a roller mill.

BACKGROUND ART

A roller mill that grinds a solid fuel, such as coal, supplied to a rotary table using a roller has been disclosed (refer to Patent Document 1, for example).

Patent Document 1 discloses a method for forming the roller into a cross-sectional shape so as to make a contact surface pressure of a grinding portion between the roller and the table uniform.

CITATION LIST

Patent Literature

Patent Literature 1: Japanese Patent No. 4101709B

SUMMARY OF INVENTION

Technical Problem

In the roller mill, a circumferential velocity of the roller and a circumferential velocity of the table differ from each other according to the respective distances from a drive shaft as a center of rotation of the table. While the same degree of wear occurs on the roller and the table at the position where the circumferential velocity of the roller equals the circumferential velocity of the table, the respective degrees of wear are not the same at positions where the circumferential velocity of the roller does not equal the circumferential velocity of the table. As a result of investigations, the present inventors have newly discovered that wear on the roller increases at positions where the circumferential velocity of the table is greater than the circumferential velocity of the roller, and wear on the table increases at positions where the circumferential velocity of the table is less than the circumferential velocity of the roller.

In such a roller mill, table replacement is not easy, and table repair requires major repair work that involves bringing a welding device into the roller mill to perform welding, and the like. On the other hand, roller repair work or replacement work can be easily performed compared to table repair work. Thus, to avoid major table repair work, it is preferable to suppress table wear to the extent possible.

In light of the above, an object of the present invention is to provide a roller mill configured to suppress wear of a rotary table having a grinding surface against which a roller is pressed to decrease a frequency of repair and replacement of the rotary table, and a method for manufacturing the roller mill.

Solution to Problem

In order to achieve the above-described object, the present invention provides the following means.

A roller mill according to the present invention includes a rotary table that rotates about a drive shaft by a driving force from a drive unit; a fuel supply unit that supplies solid fuel to the rotary table; and a roller that rotates about a rotating shaft by being pressed against a grinding surface of the rotary table and grinds the solid fuel along with rotation of the rotary table. In such a roller mill, a first position where an outer peripheral surface of the roller and the grinding surface of the rotary table come into contact with each other and a circumferential velocity of the outer peripheral surface equals a circumferential velocity of the grinding surface is located further to an inner circumferential side of the rotary table than a second position where the outer peripheral surface and the grinding surface come into contact with each other at a center position in a width direction of the roller.

According to the roller mill of the present invention, table wear increases further on the inner circumferential side of the rotary table and roller wear increases further on the outer circumferential side of the rotary table than the first position where the circumferential velocity of the outer peripheral surface of the roller equals the circumferential velocity of the grinding surface of the rotary table. This first position is located further to the inner circumferential side of the rotary table than the second position where the outer peripheral surface and the grinding surface come into contact with each other at the center position in the width direction of the roller. Such an arrangement suppresses wear of the rotary table having the grinding surface against which the roller is pressed, making it possible to decrease the frequency of repair and replacement of the rotary table.

Further, in the roller mill of a first embodiment of the present invention, a radius of curvature of the outer peripheral surface of the roller is constant, and a first radius of curvature of the grinding surface at a third position corresponding to an end surface of the roller on the inner circumferential side of the rotary table is less than a second radius of curvature of the grinding surface at a fourth position corresponding to an end surface of the roller located on an outer circumferential side of the rotary table.

According to the roller mill of this embodiment, the roller and the rotary table are in close proximity to each other at the third position corresponding to the end surface of the roller on the inner circumferential side of the rotary table, and the first position is appropriately located further to the inner circumferential side of the rotary table than the second position.

Such an arrangement suppresses wear of the rotary table having the grinding surface against which the roller is pressed, making it possible to decrease the frequency of repair and replacement of the rotary table.

Further, in the roller mill of a second embodiment of the present invention, a distance in the rotating shaft direction from the first position to the third position is within 0.3 times a width of the roller.

As a result, the region in which the wear of the table increases is set to a region within 0.3 times the width of the roller, thereby making it possible to appropriately suppress wear of the rotary table having the grinding surface against which the roller is pressed.

In this second embodiment, the region in which the wear of the table increases is preferably set to 0.15 times the width of the roller.

As a result, a position where the table and the roller are closest in proximity is located further to the outer circumferential side of the rotary table than the third position corresponding to the end surface of the roller on the inner circumferential side of the rotary table, making it possible to appropriately maintain a grinding efficiency of the solid fuel.

Further, the roller mill of a third embodiment of the present invention further includes a dam ring provided on an end portion on the outer circumferential side of the rotary table. The dam ring suppresses discharge of the ground solid fuel to the outside of the rotary table and has a tapered surface that is inclined so as to decrease in height from the outer circumferential side toward the inner circumferential side of the rotary table.

As a result, the solid fuel ground on the outer circumferential side of the rotary table moves readily compared to that in a roller mill that includes a dam ring not having a tapered surface inclined so as to decrease in height from the outer circumferential side toward the inner circumferential side in the of the rotary table. Thus, the solid fuel stays in large quantities on the rotary table, and the accumulated solid fuel is caught between the rotary table and the roller, making it possible to suppress a movement of the first position to the outer circumferential side of the rotary table. This makes it possible to prevent defects in which the first position moves to the outer circumferential side of the rotary table, thereby increasing the size of the region of the rotary table having increasing wear.

Further, the roller mill of a fourth embodiment of the present invention further includes an adjustment mechanism that allows adjustment of a distance of the roller to the drive shaft of the rotary table.

As a result, when the wear of the rotary table and the roller progresses and the grinding efficiency of the solid fuel decreases, the position where the rotary table and the roller come into contact with each other is shifted, making it possible to improve the grinding efficiency of the solid fuel.

Further, a method for manufacturing a roller mill according to the present invention is a method for manufacturing a roller mill that includes a rotary table that rotates about a drive shaft by a driving force from a drive unit; a fuel supply unit that supplies solid fuel to the rotary table; and a roller that rotates about a rotating shaft by being pressed against a grinding surface of the rotary table and grinds the solid fuel along with rotation of the rotary table. The method includes a rotary table installing step of installing the rotary table; and a roller installing step of installing the roller so that a first position where an outer peripheral surface of the roller and the grinding surface of the rotary table come into contact with each other and a circumferential velocity of the outer peripheral surface equals a circumferential velocity of the grinding surface is located further to an inner circumferential side of the rotary table than a second position where the outer peripheral surface and the grinding surface come into contact with each other at a center position in a width direction of the roller.

According to the method for manufacturing a roller mill of the present invention, table wear increases further on the inner circumferential side of the rotary table and roller wear increases further on the outer circumferential side of the rotary table than the first position where the circumferential velocity of the outer peripheral surface of the roller equals the circumferential velocity of the grinding surface of the rotary table. This first position is located further to the inner circumferential side of the rotary table than the second position where the outer peripheral surface and the grinding surface come into contact with each other at the center position in the width direction of the roller. Such an arrangement suppresses wear of the rotary table having the grinding surface against which the roller is pressed, making it possible to decrease the frequency of repair and replacement of the rotary table.

Further, the method for manufacturing a roller mill of another embodiment of the present invention further includes a rotary table forming step of forming the rotary table so that a radius of curvature of the outer peripheral surface of the roller is constant, and a first radius of curvature of the grinding surface at a third position corresponding to an end surface of the roller on the inner circumferential side of the rotary table is less than a second radius of curvature of the grinding surface at a fourth position corresponding to an end surface of the roller on an outer circumferential side of the rotary table.

According to the method for manufacturing a roller mill of this embodiment, a roller mill is manufactured in which the roller and the rotary table are in close proximity to each other at the third position corresponding to the end surface of the roller on the inner circumferential side of the rotary table, and the first position is appropriately located further to the inner circumferential side of the rotary table than the second position.

Such an arrangement suppresses wear of the rotary table having the grinding surface against which the roller is pressed, making it possible to decrease the frequency of repair and replacement of the rotary table.

Advantageous Effect of Invention

According to the present invention, it is possible to provide a roller mill that suppresses wear of a rotary table having a grinding surface against which a roller is pressed, making it possible to decrease a frequency of repair and replacement of the rotary table, and a method for manufacturing the roller mill.

DESCRIPTION OF EMBODIMENTS

Figure 1:
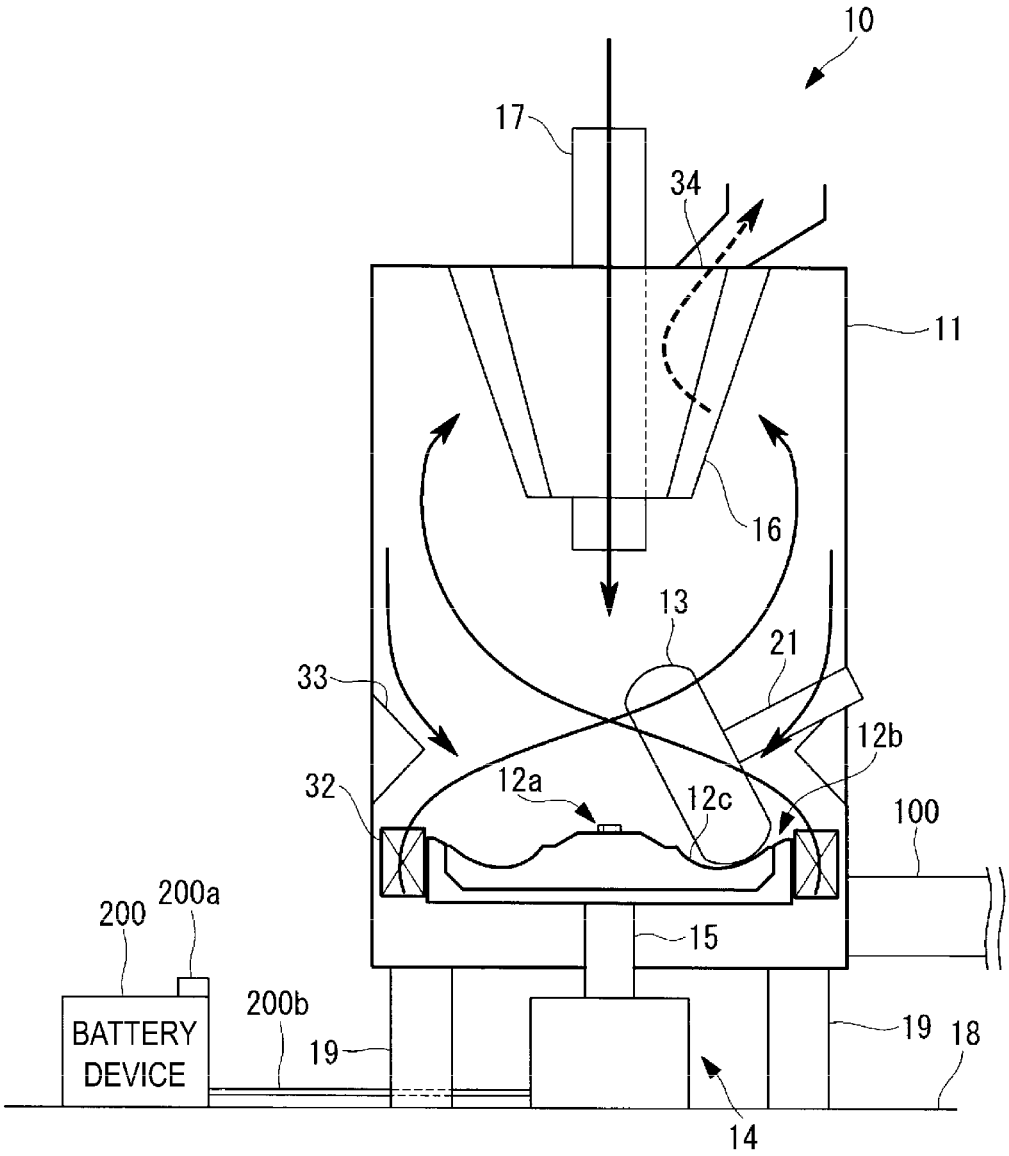
FIG. 1 is a vertical cross-sectional view of a roller mill according to an embodiment of the present invention.

The following describes a roller mill of an embodiment of the present invention, with reference to the drawings.

A roller mill 10 of the present embodiment includes a rotary table 12 that rotates about a drive shaft 15 by a driving force from a drive unit 14, a raw coal adding tube (fuel supply unit) 17 that supplies solid fuel to the rotary table 12, and a roller 13 that grinds the solid fuel such as coal along with rotation of the rotary table 12.

Then, in the roller mill 10 of the present embodiment, a rolling point (first position) where an outer peripheral surface of the roller 13 and a grinding surface of the rotary table 12 come into contact with each other and a circumferential velocity of the outer peripheral surface of the roller 13 equals a circumferential velocity of the grinding surface is located further to the inner circumferential side of the rotary table 12 than a position (second position) where the outer peripheral surface and the grinding surface come into contact with each other at the center position in the width direction of the roller 13.

The following describes in detail the roller mill 10 of the present embodiment. The roller mill 10 of the present embodiment is a device called a vertical mill.

As illustrated in FIG. 1, the roller mill 10 includes a hollow mill body 11 having a substantially cylindrical shape, the rotary table 12 disposed in a lower portion of the mill body 11 and attached rotatably about an axial line that extends in a vertical direction, the roller 13 that is pressed against an outer peripheral portion 12*b* of the rotary table 12 and grinds the solid fuel in coordination with the rotary table 12, the drive unit 14 that rotates the rotary table 12, and a power supply device 200.

The drive unit 14 includes an electric motor and a reduction gear. The reduction gear, which reduces a rotating speed of the electric motor, is connected to a center portion 12*a* of the rotary table 12 via the drive shaft 15. Further, the drive unit 14 is supplied with power from the power supply device 200 via a power supply cable 200*b*, and operates the electric motor with the supplied power. The power supply device 200 includes a detection unit 200*a* that detects a current value of current supplied to the drive unit 14.

The roller mill 10 further includes a rotary classifier 16 disposed in an upper portion of the mill body 11, and the raw coal adding tube 17 that is mounted so as to penetrate through an upper end of the mill body 11 and supplies solid fuel fed from the upper portion to the center portion 12*a* of the rotary table 12. The lower end portion of the mill body 11 is in communication with a flow channel 100, and primary air flows through the flow channel 100 into the lower end portion of the mill body 11. The mill body 11 is fixed to the upper surface of a rectangular parallelepiped block 19 that is made of concrete and laid on a floor 18.

While only one roller 13 is illustrated in FIG. 1, a plurality of rollers 13 are disposed at constant intervals in an outer circumferential direction so as to press the outer peripheral portion 12*b* of the rotary table 12. For example, three rollers 13 are disposed on the outer peripheral portion 12*b* at angular intervals of 120°. In this case, sections (pressed sections) where the three rollers 13 come into contact with the outer peripheral portion 12*b* of the rotary table 12 are equidistant from the center portion 12*a* of the rotary table 12.

A plurality of air outlets 32 that discharge the primary air that flows in through the flow channel 100 to a space above the rotary table 12 in the mill body 11 are provided on an outer side of the rotary table 12. Vanes 33 are disposed above the air outlets 32, and impart a swirling force to the primary air blown from the air outlets 32. The primary air imparted with the swirling force by the vanes 33 forms an air stream such as indicated by the arrow in FIG. 1, and introduces the solid fuel ground on the rotary table 12 to the rotary classifier 16 located above the mill body 11. Note that, among the ground matter of the solid fuel mixed into the primary air, ground matter having a large particle size falls without reaching the rotary classifier 16 and is once again returned to the rotary table 12.

The rotary classifier 16 includes a blade that rotates about a cylindrical shaft of the mill body 11 having a substantially cylindrical shape. Among the ground matter of the solid fuel that has reached the rotary classifier 16, only pulverized fuel having a particle size smaller than a predetermined particle size flows into the blade and is discharged from an fine particle exit 34 due to a relative balance between a centrifugal force and a centripetal force that occur as a result of the rotating blade and the flow of the primary air. The fine particle exit 34 is in communication with a supply flow channel (not illustrated) connected to a pulverized coal boiler (not illustrated).

Figure 2:
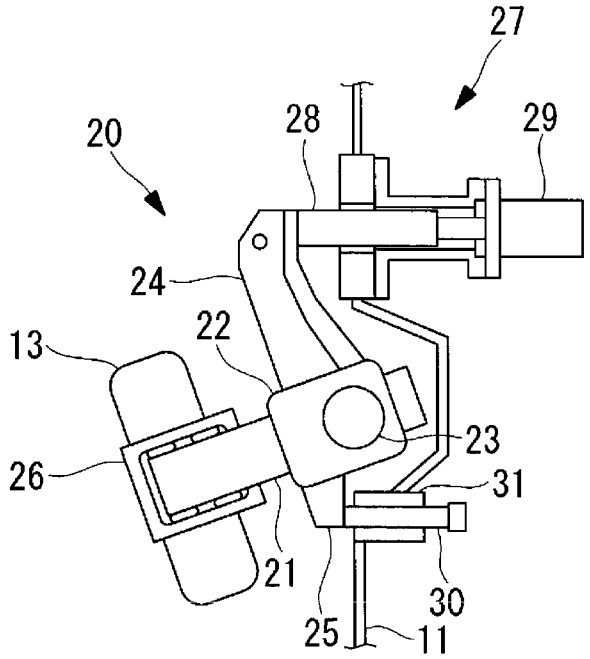
FIG. 2 is a cross-sectional view illustrating a roller of the roller mill illustrated in FIG. 1.

Next, description will be given of the configuration of the roller 13 and a roller supporter 20 using FIG. 2. The roller 13 is supported on the mill body 11 by the roller supporter 20. The roller supporter 20 includes a rotating shaft 21 to which the roller 13 is attached, a body 22 that retains the rotating shaft 21, a support shaft 23 fixed and attached to a side portion of the body 22, an arm 24 attached to an upper surface of the body 22 so as to extend upward, and a protruding portion 25 provided to a lower surface of the body 22 so as to protrude downward.

A hollow hub 26 having a substantially cylindrical shape is attached to a center of the roller 13. The roller 13 is attached to a tip portion of the rotating shaft 21 with the hub 26 located therebetween. Thus, the roller 13 is rotatable in the circumferential direction about the rotating shaft 21.

The support shaft 23 is disposed so that the axial line thereof is in a substantially horizontal direction, and so as to extend in a tangential direction of the circular shape of the rotary table 12. The roller supporter 20 is pivotable about the support shaft 23 and, by pivoting about the support shaft 23, causes a distance from the roller 13 to the outer peripheral portion 12*b* of the rotary table 12 to change.

A load applying unit 27 that presses the upper end portion of the arm 24 is attached to the mill body 11. The load applying unit 27 includes an intermediate piston 28 attached to the mill body 11 so as to be movable in a longitudinal direction, and a hydraulic load unit 29 that is attached to an outer circumference of the mill body 11 and presses an outer side end portion of the intermediate piston 28. An inner side end portion of the intermediate piston 28 is connected to an upper end on the outer peripheral side of the arm 24. The load applying unit 27 moves the intermediate piston 28 in the longitudinal direction by the hydraulic load unit 29, causing the roller supporter 20 to swing about the support shaft 23.

The roller 13 swings about the support shaft 23 by the hydraulic load unit 29, and the outer peripheral surface of the roller 13 is pressed against a grinding surface 12*c* of the rotary table 12. As a result, the roller 13 rotates about the rotating shaft 21.

When the roller supporter 20 swings about the support shaft 23 to a fixed position, the protruding portion 25 butts against a stopper 30. The stopper 30 functions as a restricting member that restricts the movement of the roller 13 in a direction in which the roller 13 presses against the rotary table 12. The stopper 30 is a screw member having male threads formed on an outer circumferential surface, and threadedly engages with female threads formed on an inner circumference of a retaining unit 31 attached so as to penetrate the mill body 11. The stopper 30 is manually rotatable using a dedicated special tool. As a result, the relative position of the roller 13 with respect to the rotary table 12 when the roller 13 is closest to the rotary table 12 is adjustable.

Figure 3:
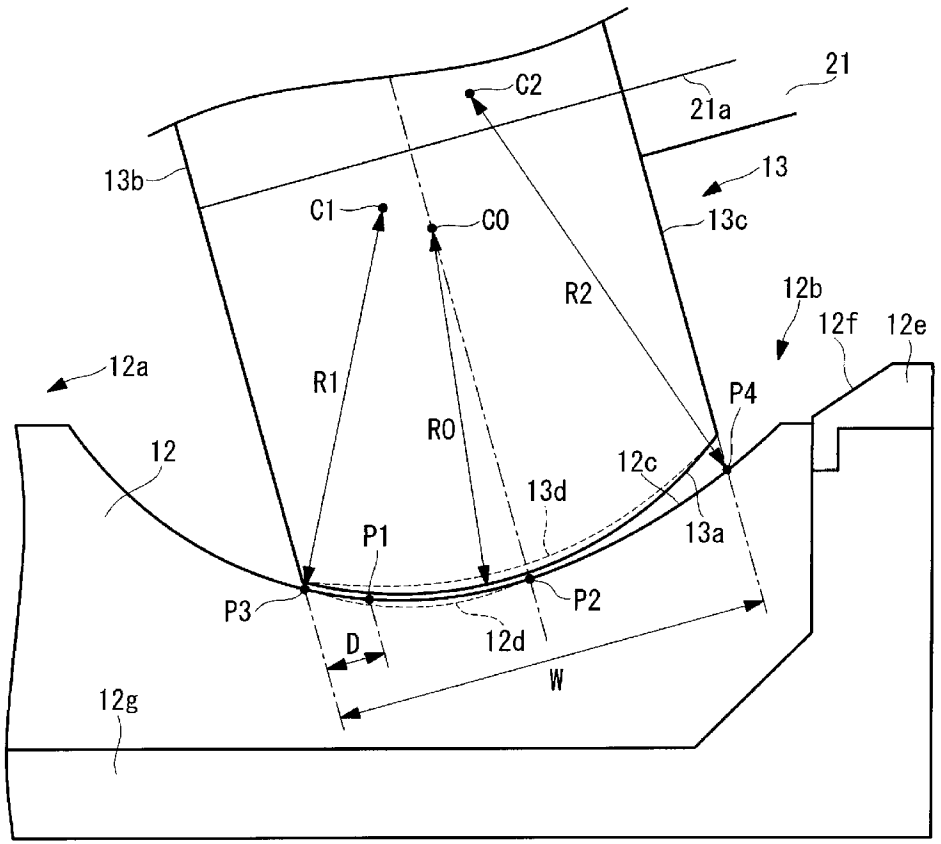
FIG. 3 is a partial enlarged view of the roller and a rotary table of the roller mill illustrated in FIG. 1.

Further, the roller supporter 20 of the present embodiment includes an adjustment mechanism (not illustrated) that moves the roller 13 toward the inner circumferential side of the rotary table 12 along a central axis 21*a* of the rotating shaft 21 in FIG. 3. This adjustment mechanism allows the distance from the roller 13 to the drive shaft 15 of the rotary table 12 to be adjustable by the roller supporter 20. For example, when wear of the roller 13 and the rotary table 12 has progressed, the position of the roller 13 is adjusted so as to be closer to the drive shaft 15 of the rotary table 12, making it possible to grind the solid fuel at a section where wear has not progressed. As a result, the progress of wear is averaged among all locations, making it possible to extend the service life of the roller 13 and the rotary table 12.

Next, the shapes and arrangement of the rotary table 12 and the roller 13 of the present embodiment will be described using FIG. 3.

Figure 4:
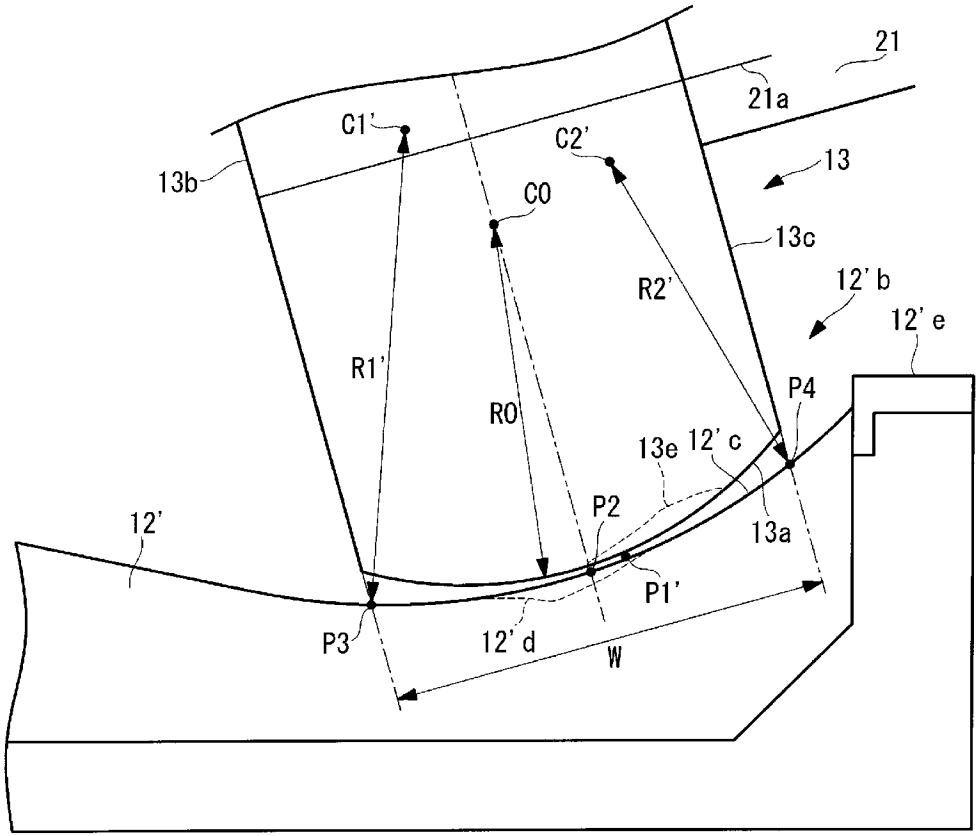
FIG. 4 is a partial enlarged view of a roller and a rotary table of a roller mill of a comparison example.

Note that, in FIGS. 3 and 4, the solid fuel is not illustrated, and the outer peripheral surface 13*a* of the roller 13 and the grinding surface 12*c* of the rotary table 12 are illustrated as not being in contact with each other. However, at the position where the outer peripheral surface 13*a* of the roller 13 and the grinding surface 12*c* of the rotary table 12 face each other, the outer peripheral surface 13*a* of the roller 13 and the grinding surface 12*c* of the rotary table 12 are in contact with each other with the solid fuel located therebetween. Then, in the present embodiment, such a state is called a state in which the outer peripheral surface 13*a* of the roller 13 and the grinding surface 12*c* of the rotary table 12 are "in contact" with each other.

As illustrated in FIG. 3, the roller 13 includes an outer peripheral surface 13*a* having a constant curvature. The constant curvature has a radius of curvature R0, using a center C0 as reference. The width of the roller 13 is W, and the position where the outer peripheral surface 13*a* at the center position in the width direction of the roller 13 and the grinding surface 12*c* of the rotary table 12 come into contact with each other is a position P2.

Figure 5:
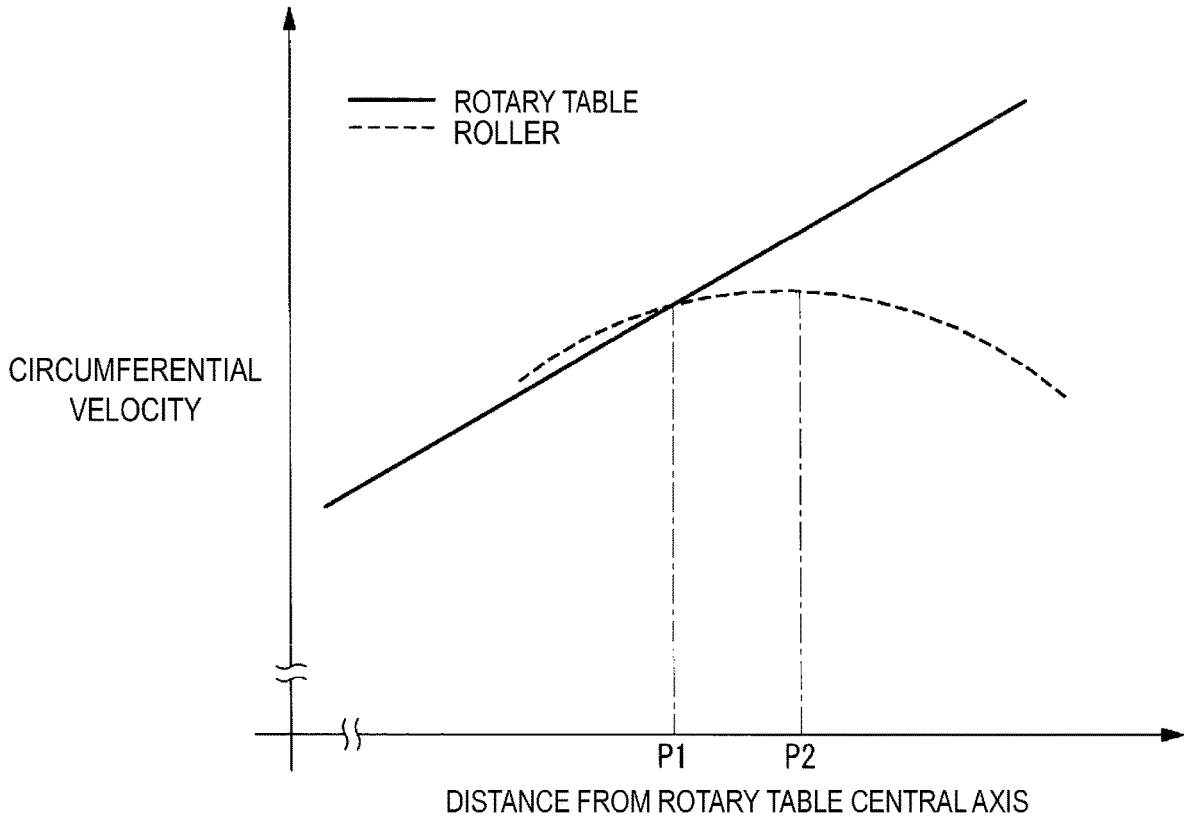
FIG. 5 is a graph showing the relationship between a distance from the central axis of the rotary table and circumferential velocities of the rotary table and the roller of the present embodiment.
Figure 6:
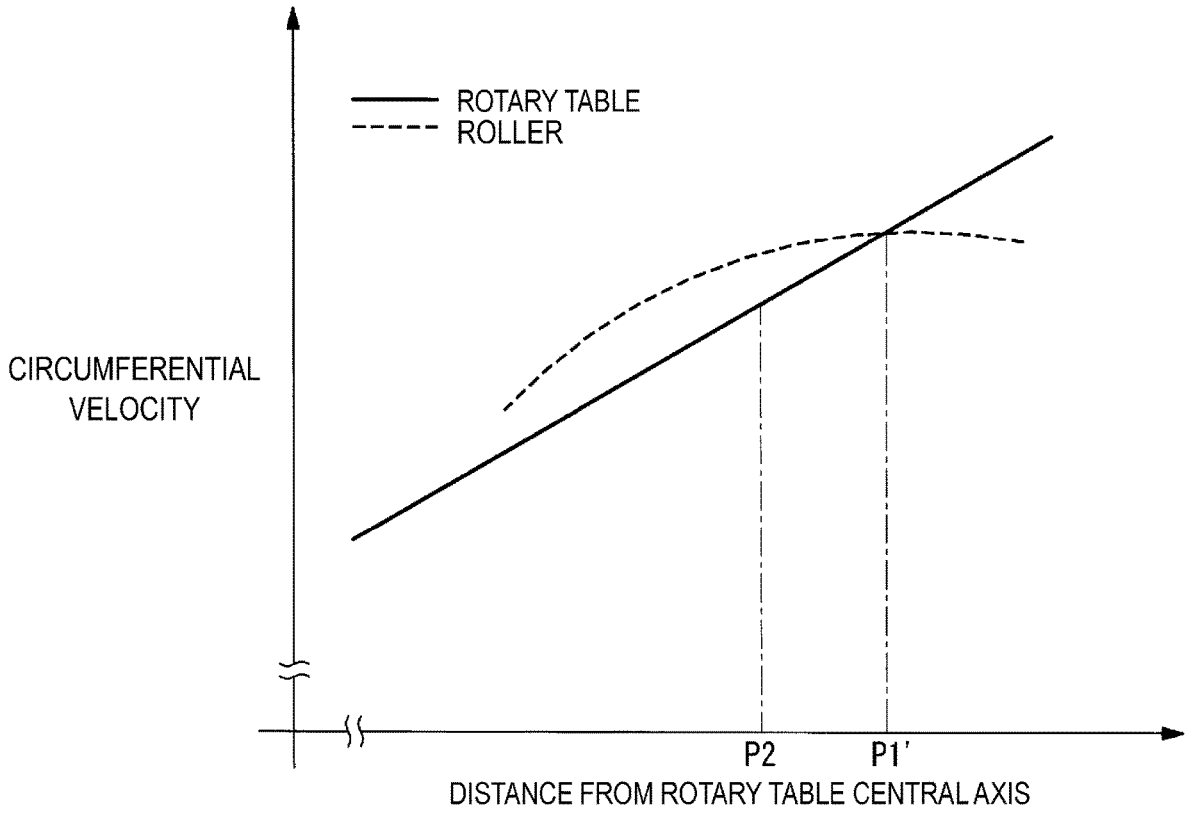
FIG. 6 is a graph showing the relationship between a distance from the central axis of the rotary table and circumferential velocities of the rotary table and the roller of the comparison example.

FIG. 5 shows the relationship between a distance from the center of the drive shaft 15 of the rotary table 12, and the circumferential velocities at that position. The circumferential velocity of the rotary table 12 is the migration velocity in the circumferential direction orthogonal to the drive shaft 15 at each position on the grinding surface 12*c* of the rotary table 12. As illustrated in FIG. 5, the rotary table 12 is a disc-like member that rotates about the drive shaft 15, and therefore increases in circumferential velocity in proportion to the distance from the center of the drive shaft 15. It should be noted that the FIGS. 5 and 6 illustrate examples of when the number of revolutions per unit time about the drive shaft 15 of the rotary table 12 is constant.

Further, the circumferential velocity of the roller 13 is the migration velocity in the circumferential direction orthogonal to the rotating shaft 21 at each position on the outer peripheral surface 12*b* of the roller 13. As illustrated in FIG. 3, the outer peripheral surface 13*a* of the roller 13 has an arc shape that protrudes at the center position in the width direction of the roller 13. As a result, as shown in FIG. 5, the circumferential velocity at the position P2 is high, and the circumferential velocity at the end portion in the rotating shaft 21 direction is low.

A position P1 shown in FIG. 5 is a position where the circumferential velocity of the outer peripheral surface 13*a* of the roller 13 equals the circumferential velocity of the grinding surface 12*c* of the rotary table 12. As shown in FIG. 5, the position P1 is located further to the inner circumferential side of the rotary table 12 than the position P2.

The position P1 is located further to the inner circumferential side of the rotary table 12 than the position P2 in this way because the radii of curvature of the grinding surface 12*c* of the rotary table 12 are not the same on the inner side and the outer circumferential side of the rotary table 12.

As illustrated in FIG. 3, a position where an extension line of an end surface 13*b* on the inner circumferential side of the rotary table 12 intersects the grinding surface 12*c* of the rotary table 12 is a position P3 (third position). Further, a position where an extension line of an end surface 13*c* on the outer circumferential side of the rotary table 12 intersects the grinding surface 12*c* of the rotary table 12 is a position P4 (fourth position).

As illustrated in FIG. 3, a radius of curvature (first radius of curvature) of the grinding surface 12*c* at the position P3 is R1 centered on a center C1. Further, a radius of curvature (second radius of curvature) of the grinding surface 12*c* at the position P4 is R2 centered on a center C2. Then, the radius of curvature R1 is less than the radius of curvature R2.

In the present embodiment, the relationship between a distance D in the central axis 21*a* direction of the rotating shaft 21 from the extension line of the end surface 13*b* of the roller 13 to the position P1, and the width W of the roller 13 is preferably set as shown in the following formula (1).

$$0 \leq D \leq 0.3 \cdot W \tag{1}$$

Furthermore, the relationship between the distance D and the width W is more preferably set as shown in the following formula (2).

$$D = 0.15 \cdot W \tag{2}$$

The formula (1) is a condition for disposing the position P1 near the end surface 13*b* side of the roller 13. Further, the formula (2) is a condition for locating the position P1 further to the outer circumferential side of the rotary table 12 than the position P3 while bringing the position P1 near the end surface 13*b* side of the roller 13.

Next, the shapes and arrangement of a rotary table 12' and the roller 13 according to a comparison example of the present embodiment will be described using FIG. 4.

The roller 13 of the comparison example illustrated in FIG. 4 is the same as the roller 13 of the present embodiment illustrated in FIG. 3. On the other hand, the rotary table 12' of the comparison example illustrated in FIG. 3 differs from the rotary table 12 of the present embodiment illustrated in FIG. 4. Specifically, a radius of curvature R1' (centered on a center position C1') at the position P3 on the grinding surface 12'*c* of the rotary table 12' differs from the radius of curvature R1 illustrated in FIG. 3. Further, a radius of curvature R2' (centered on a center position C2') at the position P4 on the grinding surface 12'*c* of the rotary table 12' differs from the radius of curvature R2 illustrated in FIG. 3.

As illustrated in FIG. 3, in the rotary table 12 of the present embodiment, the radius of curvature R1 is less than the radius of curvature R2. On the other hand, as illustrated in FIG. 4, in the rotary table 12' of the comparison example, the radius of curvature R1' is greater than the radius of curvature R2'. As a result, in the comparison example, as shown in FIG. 6, a position P1' where the circumferential velocity of the grinding surface 12'*c* of the rotary table 12' equals the circumferential velocity of the outer peripheral surface 13*a* of the roller 13 is located further to the outer circumferential side of the rotary table 12 than the position P2.

A comparison between the rotary table 12 and the roller 13 of the present embodiment and the rotary table 12' and the roller 13 of the comparison example reveals a different state of progress of wear in each area after a predetermined time (a total elapsed time of rotation of the rotary table being 2000 to 3000 hours, for example) has elapsed.

In FIG. 3, which illustrates the present embodiment, the reference numeral 13*d* denotes the outer peripheral surface of the roller 13 after the predetermined amount of time has elapsed. Further, the reference numeral 12*d* denotes the grinding surface after the predetermined amount of time has elapsed.

In FIG. 4, which illustrates the comparison example, the reference numeral 13*e* denotes the outer peripheral surface of the roller 13 after the predetermined amount of time has elapsed. Further, the reference numeral 12'*d* denotes the grinding surface after the predetermined amount of time has elapsed.

As apparent from a comparison between FIGS. 3 and 4, in the comparison example, the wear of the rotary table 12' progresses in local regions near the position P2, and the depth of the wear is great in the section where the wear has progressed the most. In contrast, in the present embodiment, the wear of the rotary table 12 progresses across a wide region from the position P3 to the position P2, and the depths of the wear at the positions are relatively uniform.

Further, as apparent from a comparison between FIGS. 3 and 4, in the comparison example, the local wear of the roller 13 progresses further on the outer circumferential side the rotary table 12' than the position P1', and the depth of the wear is great in the section where the wear has progressed the most. In contrast, in the present embodiment, the wear of the roller 13 progresses across a wide region from the position P3 to the position P4, and the depths of the wear at the positions are relatively uniform.

Further, in the comparison example, the region (grinding surface 12'*d*) in which wear has progressed on the grinding surface of the rotary table 12' is about the same in size as the region (outer peripheral surface 13*e*) in which wear has progressed on the outer peripheral surface of the roller 13.

In contrast, in the present embodiment, the region (grinding surface 12*d*) in which wear has progressed on the grinding surface of the rotary table 12 is sufficiently narrower than the region (outer peripheral surface 13*d*) in which wear has progressed on the outer peripheral surface of the roller 13.

Thus, the rolling point (position P1) where the outer peripheral surface 13*a* of the roller 13 and the rotary table 12*c* of the rotary table 12 come into contact with each other and the circumferential velocity of the outer peripheral surface 13*a* of the roller 13 equals the circumferential velocity of the grinding surface 12*c* is set further to the inner circumferential side than the position P2, thereby making the region (grinding surface 12*d*) in which the wear of the rotary table 12 increases narrower than the region (outer peripheral surface 13*d*) where the wear of the roller 13 increases. Furthermore, compared to the comparison example, the maximum depth of the wear that occurs on the rotary table 12 and the maximum depth of the wear that occurs on the roller 13 can be decreased.

Next, a dam ring 12*e* provided on an end portion of the outer peripheral portion 12*b* of the rotary table 12 will be described.

The dam ring 12*e* of the present embodiment illustrated in FIG. 3 is a member that suppresses discharge of the solid fuel ground by the rotary table 12 and the roller 13 to the outer circumferential side of the rotary table 12, and causes a fixed amount of the solid fuel to accumulate on the rotary table 12. The dam ring 12*e* is a circular member coaxially disposed with the drive shaft 15, and is joined by welding or the like to an outer circumferential end of a base portion 12 *g* of the rotary table 12 that rotates about the drive shaft 15.

A tapered surface 12*f* is formed on the dam ring 12*e* of the present embodiment. The tapered surface 12*f* inclines so as to decrease in height at a constant slope from the outer circumferential side toward the inner circumferential side of the rotary table 12. The solid fuel on the rotary table 12 gradually moves from the inner circumferential side toward the outer circumferential side of the rotary table 12 by the centrifugal force applied by the rotation of the rotary table 12. The solid fuel that has reached the outer peripheral portion 12*b* passes over the incline of the tapered surface 12*f*, and is discharged to the outside of the rotary table 12. The dam ring 12*e* of the present embodiment decreases in height at a constant slope from the outer side toward the inner side, allowing the solid fuel to be readily discharged to the outside of the rotary table 12.

On the other hand, a dam ring 12'*e* of the comparison example illustrated in FIG. 4 has a shape having a constant height from the outer circumferential side toward the inner circumferential side of the rotary table 12'. As a result, compared to the dam ring 12*e* of the present embodiment, the structure makes it difficult to discharge the solid fuel to the outside of the rotary table. While the dam ring 12'*e* of the comparison example has the advantage of making it possible to increase the amount of solid fuel accumulated on the rotary table 12', a large amount of the solid fuel is readily caught between the roller 13 and the rotary table 12 on the inner circumferential side of the rotary table 12. When a large amount of solid fuel is caught between the roller 13 and the rotary table 12, the possibility arises that the position P1 as the rolling point will move to the outer circumferential side of the rotary table 12. According to the dam ring 12*e* of the present embodiment, it is possible to suppress the movement of the position P1 as the rolling point to the outer circumferential side of the rotary table 12.

Figure 7:
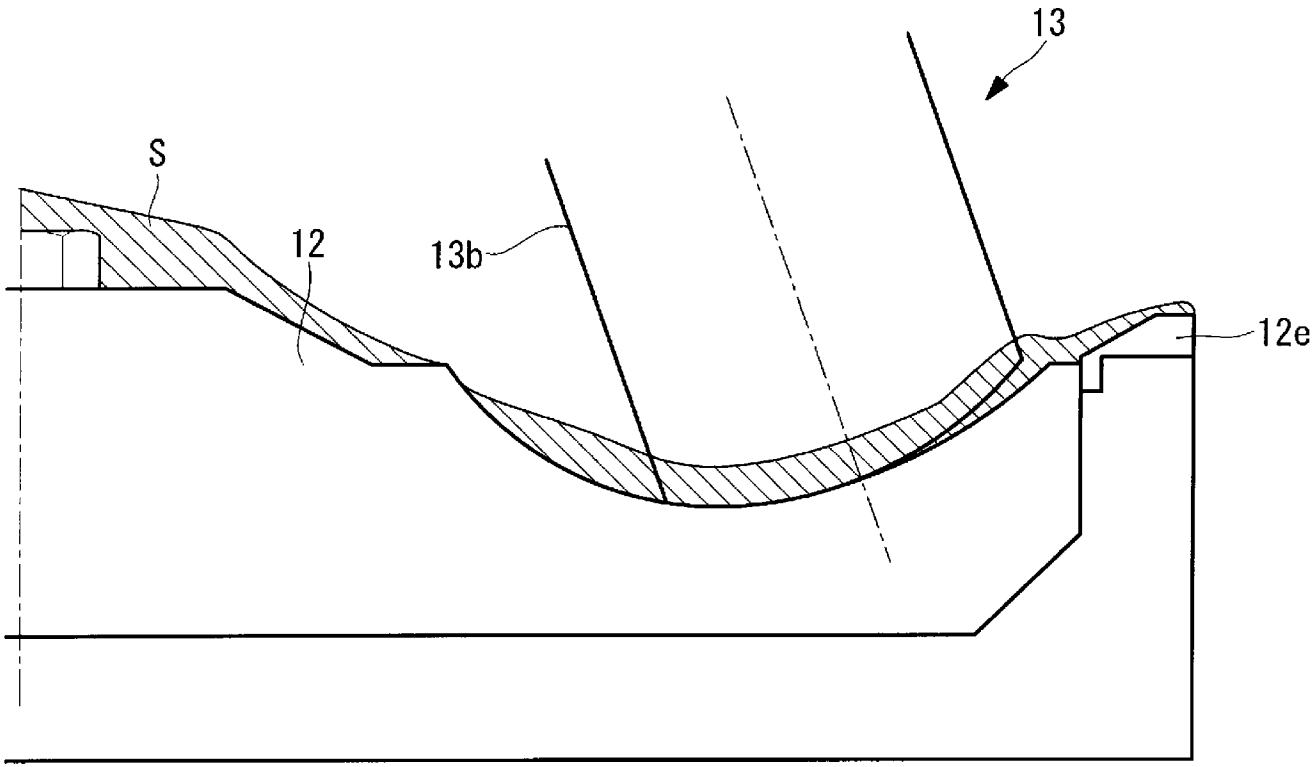
FIG. 7 is a partial enlarged view illustrating a solid fuel accumulated on the rotary table of the present embodiment.

FIG. 7 illustrates a solid fuel S accumulated on the rotary table 12 of the present embodiment. On the other hand, FIG. 8 illustrates a solid fuel S' accumulated on the rotary table 12' of the comparison example.

Figure 8:
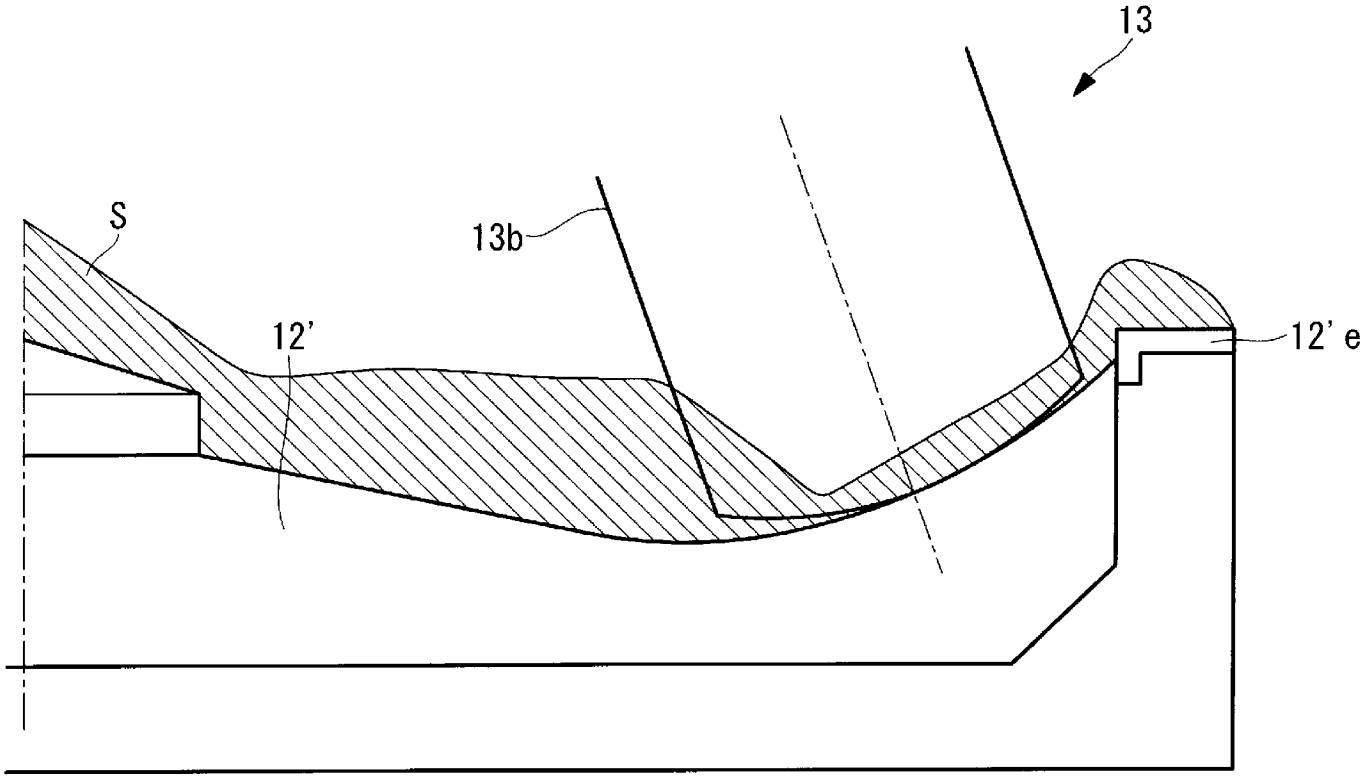
FIG. 8 is a partial enlarged view illustrating a solid fuel accumulated on the rotary table of the comparison example.

As apparent from a comparison between the solid fuel S illustrated in FIG. 7 and the solid fuel S' illustrated in FIG. 8, in the comparison example, a large amount of solid fuel has accumulated at the end surface 13*b* of the roller 13 on the inner circumferential side of the rotary table 12', resulting in the possibility that a large amount of solid fuel will be caught between the roller 13 and the rotary table 12'. In contrast, in the present embodiment, a large amount of solid fuel has not accumulated at the end surface 13*b* of the roller 13 on the inner circumferential side of the rotary table 12, and thus the possibility that a large amount of solid fuel will be caught between the roller 13 and the rotary table 12 is suppressed.

Next, a method for manufacturing the roller mill 10 of the present embodiment will be described.

The method for manufacturing the roller mill 10 of the present embodiment includes a step of configuring the components of the roller mill 10 other than the rotary table 12 and the roller 13 on the floor 18, a rotary table forming step of forming the rotary table 12, a rotary table installing step of installing the formed rotary table 12 in the mill body 11, and a roller installing step of installing the roller 13 in the mill body 11 having the rotary table 12 installed therein.

The rotary table forming step, as illustrated in FIG. 3, is a step of forming the rotary table 12 so that the radius of curvature R1 of the grinding surface 12*c* at the position P3 corresponding to the end surface 13*b* of the roller 13 on the inner circumferential side of the rotary table 12 is less than the radius of curvature R2 of the grinding surface 12*c* at the position P2 corresponding to the end surface 13*c* of the roller 13 on the outer circumferential side of the rotary table 12. The grinding surface 12*c* of the rotary table 12 is, for example, formed by hardfacing welding.

In the rotary table installing step, the rotary table 12 formed by the rotary table forming step is installed in the mill body 11 so that the driving force from the drive unit 14 is transmitted via the drive shaft 15.

The roller installing step is a step of installing the roller 13 on the roller supporter 20 of the mill body 11 so that the position P1 is located further to the inner circumferential side of the rotary table 12 than the position P2. Here, the position P1 is the position where the outer peripheral surface 13*a* of the roller 13 and the grinding surface 12*c* of the rotary table 12 come into contact with each other and the circumferential velocity of the outer peripheral surface 13*a* equals the circumferential velocity of the grinding surface 12*c*. Further, the position P2, as described above, is the position where the outer peripheral surface 13*a* and the grinding surface 12 come into contact with each other at the center position in the width direction of the roller 13.

Thus, according to the method for manufacturing the roller mill 10 of the present embodiment, the roller mill 10 that includes the roller 13 and the rotary table 12 disposed as illustrated in FIG. 3 is manufactured.

Next, the actions and effects exhibited by the above-described roller mill 10 of the present embodiment will be described.

According to the roller mill 10 of the present embodiment, wear of the rotary table 12 increases further on the inner circumferential side of the rotary table 12 and wear of the roller 13 increases further on the outer circumferential side of the rotary table 12 than the rolling point (position P1; first position) where the circumferential velocity of the outer peripheral surface 13*a* of the roller 13 equals the circumferential velocity of the grinding surface 12*c* of the rotary table 12. This first position P1 is located further to the inner circumferential side of the rotary table 12 than the position P2 (second position) where the outer peripheral surface 13*a* and the grinding surface 21*c* come into contact with each other at the center position in the width direction of the roller 13, thereby making the region (grinding surface 12*d*) in which the wear of the rotary table 12 increases narrower than the region (outer peripheral surface 13*d*) in which the wear of the roller 13 increases. Such an arrangement suppresses wear of the rotary table 12 having the grinding surface 12*c* against which the roller 13 is pressed, making it possible to decrease the frequency of repair and replacement of the rotary table 12.

Further, in the roller mill 10 of the present embodiment, the radius of curvature R0 of the outer peripheral surface 13*a* of the roller 13 is constant, and the radius of curvature R1 (first radius of curvature) of the grinding surface 12*c* at the position P3 (third position) corresponding to the end surface 13*b* of the roller 13 on the inner circumferential side of the rotary table 12 is less than the radius of curvature R2 (second radius of curvature) of the grinding surface 12*c* at the position P4 (fourth position) corresponding to the end surface 13*c* of the roller 13 on the outer circumferential side of the rotary table 12.

According to the roller mill 10 of the present embodiment, the roller 13 and the rotary table 12 are in close proximity to each other at the position P3 corresponding to the end surface 13*b* of the roller 13 on the inner circumferential side of the rotary table 12, and the above-described position P1 is appropriately located further to the inner circumferential side of the rotary table 12 than the above-described position P2.

Such an arrangement suppresses wear of the rotary table 12 having the grinding surface 12*c* against which the roller 13 is pressed, making it possible to decrease the frequency of repair and replacement of the rotary table 12.

Further, in the roller mill 10 of the present embodiment, the distance D in the rotating shaft 21 direction from the position P1 to the position P3 is within 0.3 times the width W of the roller 13.

As a result, the region in which wear of the rotary table 12 increases is set to a region within 0.3 times the width W of the roller 13, thereby making it possible to appropriately suppress wear of the rotary table 12 having the grinding surface 12*c* against which the roller 13 is pressed.

This distance D is preferably set to 0.15 times the width W of the roller.

As a result, the position where the rotary table 12 and the roller 13 are closest in proximity to each other is located further to the outer circumferential side of the rotary table 12 than the position P3 corresponding to the end surface 13*b* of the roller 13 on the inner circumferential side of the rotary table 12, making it possible to appropriately maintain the grinding efficiency of the solid fuel.

Further, the roller mill 10 of the present embodiment further includes the dam ring 12*e* that is provided on the end portion on the outer circumferential side of the rotary table 12 and suppresses the discharge of the ground solid fuel to the outer circumferential side of the rotary table 12. The dam ring 12*e* has the tapered surface 12*f* that is inclined so as to decrease in height from the outer side toward the inner circumferential side of the rotary table 12.

As a result, the solid fuel ground on the outer circumferential side of the rotary table 12 moves readily compared to the roller mill that includes the dam ring 12'*e* of the comparison example not having the tapered surface 12*f* inclined so as to decrease in height from the outer side toward the inner circumferential side of the rotary table 12. Thus, the solid fuel accumulates in large quantities on the rotary table 12, and the accumulated solid fuel is caught between the rotary table 12 and the roller 13, making it possible to suppress the movement of the above-described position P1 to the outer circumferential side of the rotary table 12. This makes it possible to prevent defects in which the position P1 as the rolling point moves to the outer circumferential side of the rotary table 12, thereby increasing the size of the region of the rotary table 12 having increasing wear.

Further, the roller mill 10 of the present embodiment includes the roller supporter 20 (adjustment mechanism) that allows adjustment of the distance of the roller 13 to the drive shaft 15 of the rotary table 12.

As a result, when the wear of the rotary table 12 and the roller 13 progresses and the grinding efficiency of the solid fuel decreases, the position where the rotary table 12 and the roller 13 come into contact with each other is shifted, making it possible to improve the grinding efficiency of the solid fuel. Further, the progress of wear is averaged among all locations, making it possible to extend the service life of the roller 13 and the rotary table 12.

REFERENCE SIGNS LIST

10 Roller mill
11 Housing
12 Rotary table
12*a* Center portion
12*b* Outer circumferential portion
12*c* Grinding surface
12*e* Dam ring
12*f* Tapered surface

13 Roller
13*a* Outer peripheral surface
13*b*, 13*c* End surface
15 Drive shaft
17 Raw coal adding tube (fuel supply unit)
20 Roller supporter (adjustment mechanism)
21 Rotating shaft
21*a* Central axis
23 Support shaft

The invention claimed is:

1. A roller mill comprising:

a rotary table that rotates about a drive shaft by a driving force from a drive unit;

a fuel supply unit that supplies solid fuel to the rotary table; and a roller that rotates about a rotating shaft by being pressed against a grinding surface of the rotary table and grinds the solid fuel along with rotation of the rotary table;

a first position where an outer peripheral surface of the roller and the grinding surface of the rotary table come into contact with each other and a circumferential velocity of the outer peripheral surface equals a circumferential velocity of the grinding surface being located further to an inner circumferential side of the rotary table than a second position where the outer peripheral surface and the grinding surface come into contact with each other at a center position in a width direction of the roller;

a radius of curvature of the outer peripheral surface of the roller being constant;

a first radius of curvature of the grinding surface at a third position corresponding to a first end surface of the roller on the inner circumferential side of the rotary table being less than a second radius of curvature of the grinding surface at a fourth position corresponding to a second end surface of the roller on an outer circumferential side of the rotary table; and a distance in the rotating shaft direction from the first position to the third position being within 0.3 or 0.15 times a width of the roller.

2. A roller mill according to claim 1, further comprising:

a dam ring provided on an end portion on the outer circumferential side of the rotary table, the dam ring suppressing discharge of the ground solid fuel to the outside of the rotary table and having a tapered surface that is inclined so as to decrease in height from the outer side toward the inner circumferential side of the rotary table.

3. A roller mill according to claim 1, further comprising:

an adjustment mechanism that allows a distance of the roller to the drive shaft of the rotary table to be adjusted.

4. A method for manufacturing a roller mill including a rotary table that rotates about a drive shaft by a driving force from a drive unit; a fuel supply unit that supplies solid fuel to the rotary table; and a roller that rotates about a rotating shaft by being pressed against a grinding surface of the rotary table, grinds the solid fuel along with rotation of the rotary table, and has an outer peripheral surface with a constant radius of curvature; the method comprising:

a rotary table installing step of installing the rotary table;

a roller installing step of installing the roller so that a first position where the outer peripheral surface of the roller and the grinding surface of the rotary table come into contact with each other and a circumferential velocity of the outer peripheral surface equals a circumferential velocity of the grinding surface is located further to an inner circumferential side of the rotary table than a second position where the outer peripheral surface and the grinding surface come into contact with each other at a center position in a width direction of the roller; and a rotary table forming step of forming the rotary table so that a first radius of curvature of the grinding surface at a third position corresponding to a first end surface of the roller on the inner circumferential side of the rotary table is less than a second radius of curvature of the grinding surface at a fourth position corresponding to a second end surface of the roller on an outer circumferential side of the rotary table, and a distance in the rotating shaft direction from the first position to the third position is within 0.3 or 0.15 times a width of the roller.

* * * * *